US005958854A

United States Patent [19]

Laing et al.

[11] Patent Number: 5,958,854

[45] Date of Patent: Sep. 28, 1999

[54] SILVER POLISH FORMULATION CONTAINING THIOUREA

[75] Inventors: Mark Laing, Beverley; Mark Beeston, Birmingham, both of United Kingdom

[73] Assignee: Reckitt & Colman Products Limited, London, United Kingdom

[21] Appl. No.: 08/869,685

[22] Filed: Jun. 5, 1997

[30] Foreign Application Priority Data

Jun. 8, 1996 [GB] United Kingdom ..... 9612016

[51] Int. Cl.[6] ..... C11D 7/08; C11D 17/06; C23G 1/10

[52] U.S. Cl. ..... 510/218; 510/245; 510/254; 510/255; 510/263; 510/401; 510/402; 510/439; 510/446; 510/477; 510/509

[58] Field of Search ..... 510/218, 245, 510/254, 255, 261, 263, 273, 298, 297, 401, 477, 402, 439, 509, 446

[56] References Cited

U.S. PATENT DOCUMENTS

| | | | |
|---|---|---|---|
| 2,628,199 | 2/1953 | Lowenheim | 252/142 |
| 3,114,657 | 12/1963 | Stilwell | 134/28 |
| 3,481,882 | 12/1969 | Streicher | 510/263 |
| 3,813,342 | 5/1974 | Cooperman | 252/170 |
| 3,965,015 | 6/1976 | Bauman | 252/8.8 |
| 4,115,293 | 9/1978 | Schoenholz et al. | 252/102 |
| 4,217,234 | 8/1980 | Krisp et al. | 252/99 |
| 4,541,945 | 9/1985 | Anderson et al. | 510/253 |
| 4,561,892 | 12/1985 | Eriksson | 106/3 |
| 4,738,790 | 4/1988 | Miyajima et al. | 510/108 |
| 4,828,749 | 5/1989 | Kruse et al. | 252/135 |
| 4,839,078 | 6/1989 | Kruse et al. | 252/99 |
| 4,897,212 | 1/1990 | Kruse et al. | 252/99 |
| 5,264,144 | 11/1993 | Moroney et al. | 252/117 |
| 5,269,997 | 12/1993 | Leslie | 264/320 |
| 5,447,575 | 9/1995 | Crump et al. | 134/42 |
| 5,614,028 | 3/1997 | Rodzewich | 134/2 |
| 5,630,883 | 5/1997 | Steer et al. | 134/22.13 |
| 5,653,917 | 8/1997 | Singerman | 252/389.62 |

FOREIGN PATENT DOCUMENTS

| | | | |
|---|---|---|---|
| 0 039 193 A1 | 11/1981 | European Pat. Off. . | |
| 0 146 010 A2 | 6/1985 | European Pat. Off. | C23G 1/20 |
| 0 425 018 A2 | 5/1991 | European Pat. Off. | C11D 3/386 |
| 968189 | 1/1958 | Germany . | |
| 1 915 693 | 10/1970 | Germany | A01K 1/00 |
| 01096298 | 4/1989 | Japan . | |
| 04214884 | 8/1992 | Japan . | |
| 1109426 | 8/1984 | U.S.S.R. . | |
| 1731795 | 5/1992 | U.S.S.R. . | |
| 781521 | 8/1957 | United Kingdom . | |
| 1062173 | 3/1967 | United Kingdom . | |
| 1242920 | 8/1971 | United Kingdom . | |
| 1436922 | 5/1976 | United Kingdom . | |
| 2254857 | 10/1992 | United Kingdom . | |
| 2288813 | 11/1995 | United Kingdom . | |
| 86/06760 | 11/1986 | WIPO | C23G 1/00 |

OTHER PUBLICATIONS

Abstract for Japanese Patent No. 4–214884, Aug. 5, 1992.

*Primary Examiner*—Lorna Douyon
*Attorney, Agent, or Firm*—Fish & Richardson P.C.

[57] ABSTRACT

A chemical cleaning composition for silver- or copper-containing surfaces consists of a water-soluble solid or powder comprising thiourea or a derivative thereof, and is formulated in unit application form, e.g. in tablet or sachet form. A preferred composition comprises up to 60% thiourea or a derivative thereof; up to 4% surfactant; not more than 40% acidifier; less than 20% disintegrant; up to 10% binder; 0–1% lubricant; and up to 40% diluent.

3 Claims, No Drawings

SILVER POLISH FORMULATION CONTAINING THIOUREA

FIELD OF THE INVENTION

This invention relates to cleaning surfaces made of silver or copper, and of alloys based on silver or on copper (e.g. brass), and more particularly but not exclusively provides compositions and formulations suitable for cleaning silver objects such as those used for ornamental, decorative or functional purposes. The objects whose surfaces are to be cleaned may, for example, be formed of sterling silver, solid silver, electroplated nickel silver (EPNS), or brass. Typical examples of objects which are often fabricated from silver or silver-based metals are cutlery, goblets, candlesticks, figurines, frames for photographs, and jewelry. For convenience, the invention will be described hereafter in relation to the cleaning of silver surfaces, it being understood that the invention is of wider applicability, as already indicated.

BACKGROUND OF THE INVENTION

It is well-known that a drawback of silver is the tendency to form a dark coating (tarnish) on its surface under normal atmospheric conditions. The tarnish forms quickly and is difficult to remove.

Prior art cleaning compositions for silver items are conventionally of two types, namely (a) abrasive polishes and (b) chemical solvents for the tarnish. As well as these, electrochemical methods have been used. Polishes abrade the tarnish and may also wear away the silver itself, which is a problem particularly with EPNS, and the fine abrasive materials used can lodge in intricate decorations on the surface of the object, from where they are hard to remove.

Currently, the most common form of chemical solvent is a "dip cleaner"; these are acidic solutions the main active ingredient of which is thiourea ($NH_2CSNH_2$).

Thiourea and its derivatives have been known for many years for use in cleaning metal surfaces. They are best known as inhibitors in the acid cleaning treatment of ferrous metals. For example, U.S. Pat. No. 1,608,622 (Schmidt et al) of Nov. 30, 1926 discloses the use of thiourea admixed with sulphuric acid for the pickling of iron and steel.

U.S. Pat. No. 2,071,966 (Bolton) of Feb. 23, 1937 discloses the use of substituted thioureas containing a hydrogenated aryl group admixed with an acid for cleaning metal surfaces.

GB 1 242 920 (Abbott Laboratories) of Aug. 18, 1971 discloses the use of thiourea derivatives for use as corrosion inhibitors for ferrous and aluminium metal bodies, particularly for use in oilfield applications. One technique suggested for the application of the inhibitor to production well casings is to form a "stick" comprising inhibitor and binders; such sticks are then dropped into the well tubing. After falling to the bottom of the well, the stick disintegrates or melts to release the inhibitor. Preferred binders for producing these inhibitor sticks are lead oxide, petroleum wax and asphalt.

U.S. Pat. No. 2,628,199 (Lowenheim) of Feb. 10, 1953 discloses a cleaning composition for silver- and copper-containing metal surfaces which comprises about 3 to 5 parts by weight of thiourea together with 1 part by weight of a normally solid acid having a pK in the range 1 to 5; preferred acids disclosed as therein are citric, tartaric and oxalic acids.

The more modern dip-cleaners are liquid formulations into which a tarnished silver article is immersed or dipped in order to remove the tarnish, leaving a clean metal surface. These dip cleaners suffer from a number of serious disadvantages in that they are hazardous to keep around the home, cause damage to surfaces if spilt, tend to precipitate over time, and develop an unsightly build up of tarnish in the product after use. Furthermore, there is no means of telling when the active ingredient is spent.

The present invention therefore seeks to provide a silver cleaner in a form that will remove tarnish without damaging the surface and which will not leave deposits in surface features and decorations, and which furthermore avoids or at least ameliorates the handling and storage problems mentioned above.

DISCLOSURE OF THE INVENTION

According to one aspect of the present invention, there is provided a chemical cleaning composition for silver- or copper-containing surfaces, which composition is characterised in that (a) it consists substantially of a water-soluble solid or powder comprising thiourea or a derivative thereof, and (b) in that it is formulated in unit application form.

The cleaning composition is preferably in tablet or sachet form. Examples of thiourea derivatives useful as the active ingredient in the cleaner are methyl thiourea and ethyl thiourea.

The composition is made up ready for use by dissolving it in water, and applying the resultant solution to the article to be cleaned, either topically or by immersing the article in the solution (i.e. dipping), the latter being the more usual technique.

A cleaning composition in accordance with this invention is relatively safe to store around the home (no spill during storage), is made up fresh every time to give cleaning performance at or close to the theoretical optimum, and no residue builds up with time. Furthermore, the user can, if he or she wishes, prepare a solution whose strength is selected according to the degree of tarnish of the article or articles to be cleaned. This is particularly easy to achieve when the composition of this invention is formulated in tablet form.

A cleaning composition in accordance with the present invention allows the user to make up as little or as much as required each time—by using one or more tablets/sachets, for example—and thus the user is not constrained by the size of the container supplied as with conventional dip products.

Preferably, a cleaning composition in accordance with this invention comprises several ingredients in addition to the active ingredient; these additional ingredients include one or more of: a surface active agent, a disintegrant, and an acidifier. Materials which protect the metal surface from further tarnishing may also advantageously be included; such tarnish-inhibiting materials include, for example, alkyl mercaptans, alkyl-aryl mercaptans, hydroxy-substituted mercapto-sulphides, mercapto-organosilicones and mercaptothioethers. One or more diluents may also be included in the formulation.

It is essential for all of the major components of the composition to be in solid or powder form when admixed together; and for them to be water-soluble. It is preferred that no residue is formed on dissolution of the composition; however, the cleaning composition will work satisfactorily if minor ingredients thereof (normally present in an amount of less than 2% by weight) generate a small but finely divided residue. To be effective, the thiourea (or thiourea derivative) and any surfactant and acidifier present must dissolve completely in water.

Preferred disintegrants include starch, cation exchange resins, crosslinked polyvinyl pyrrolidone, cellulose materials, alkali metal carbonates or bicarbonates combined with citric or tartaric acid.

When present, the surface active agent may be anionic, nonionic, cationic or amphoteric, provided it is in a form suitable for compounding as a powder or tablet.

Preferred acidification agents include citric acid, tartaric acid, sulphamic acid, oxalic acid, phthalic acid and succinic acid. Other acidification agents suitable for use in the invention include malic, maleic, fumaric, gluconic, salicylic and adipic acids. The solid acids which find application in acid denture cleaning products are useful in this invention.

Preferred diluents include dicalcium phosphate, lactose, microcrystalline cellulose, sodium chloride, and potassium sulphate.

The cleaning compositions of the invention will normally be formulated as tablets or sachets and will typically contain in addition to the above a glidant, perfume, lubricant and a binder. They may also include one or more dyestuffs and/or pigments.

When formulated as a tablet, a cleaning composition of the invention will typically comprise the following ingredients (all percentages being in weight):

Cleaning Agent (e.g. thiourea): less than 60%, preferably 10 to 50%

Surfactant: less than 4.0%, preferably 0.15 to 0.5% anionic surfactant, e.g. sodium lauryl sulphate Acidifier: less than 40% total acid, typically 15 to 30% total acid. Sulphamic acid and citric acid are preferred.

Disintegrant: less than 20%, preferably 5 to 12% in total of an alkali metal carbonate and/or bicarbonate.

Binder: less than 10%, conveniently 3 to 7% polyethylene glycol 4,000.

Diluent: less than 40%, preferably 10 to 20%; typically potassium sulphate.

Lubricant: 0 to about 1%, preferably less than 1%, more preferably 0.05 to 0.2%;

Perfume: 0 to about 1%, preferably less than 1%.

Dyestuffs/pigments: less than 1%.

EXAMPLE

The following example illustrates one formulation in accordance with the invention (all % are by weight):

| | |
|---|---|
| 50% | Thiourea |
| 0.25% | Sodium lauryl sulphate |
| 17% | Sulphamic acid |
| 5.5% | Citric acid |
| 5.4% | Sodium Carbonate |
| 2.8% | Sodium Bicarbonate |
| 4.0% | Polyethylene glycol 4000 |
| 15% | Sodium Sulphate |

If desired, part or all of the composition may be subjected to an initial pre-granulation or pre-compacting step. The formulation is formed into tablets using conventional compacting equipment, e.g. a standard rotary press such as the "Perfecta 1000" manufactured by Wilhelm Fette GmbH. The initial compression (precompression) of the powder will generally be not more than 40kN and the main compression will generally be not more than 120kN. The resulting tablet hardness will generally be at least 140N and is preferably about 180N.

The resultant tablet was tested according to the following protocol:

Two 4.0g tablets were dissolved in 96g of warm water (50° C.), giving a 4% solution of thiourea at pH 2.0. This solution was divided into several aliquots for testing on various forms of tarnished silverware, in particular solid silver spoons, silver jewelry and EPNS cutlery. In every case the solution effectively removed tarnish, leaving all articles shining and clean.

We claim:

1. A chemical cleaning composition for silver- or copper-containing surfaces which comprises a water-soluble solid or powder comprising, as the active chemical cleaning agent, from 10% to 50% by weight thiourea or a derivative thereof, and further comprising from 0.15% to 0.50% by weight of a surface active agent;

from 5% to 12% by weight of a disintegrant;

from 15% to 30% by weight of an acidifier;

from 0% to about 1% by weight of a lubricant;

from 0% to about 1% by weight of perfume;

from 10% to 20% by weight of potassium sulphate as a diluent; and from 3% to 7% by weight of polyethylene glycol 4000 as a binder.

2. A composition as claimed in claim 1, wherein said acidifier is citric or sulphamic acid.

3. A composition as claimed in claim 1, wherein said disintegrant is an alkali metal carbonate or bicarbonate.

* * * * *